US005416675A

United States Patent [19]

DeBeaux

[11] Patent Number: 5,416,675

[45] Date of Patent: May 16, 1995

[54] ILLUMINATED HELMET

[76] Inventor: Robert J. DeBeaux, 10916 Ives St., Ft. Worth, Tex. 76108

[21] Appl. No.: 303,936

[22] Filed: Sep. 9, 1994

[51] Int. Cl.[6] ..... F21L 15/14

[52] U.S. Cl. ..... 362/106; 362/72; 362/276; 362/800; 362/802

[58] Field of Search ..... 362/72, 105, 106, 802, 362/800, 276, 251; 2/209.13

[56] References Cited

U.S. PATENT DOCUMENTS

| | | | |
|---|---|---|---|
| 4,195,328 | 3/1980 | Harris, Jr. | 362/106 X |
| 4,891,736 | 1/1990 | Gouda | 362/105 |
| 4,901,210 | 2/1990 | Hanabusa | 362/106 |
| 5,155,669 | 10/1992 | Yamuro | 362/252 |
| 5,313,187 | 5/1994 | Choi et al. | 340/331 |

FOREIGN PATENT DOCUMENTS 2076276 12/1981 United Kingdom .

*Primary Examiner*—Stephen F. Husar
*Attorney, Agent, or Firm*—Richard C. Litman

[57] ABSTRACT

An automatically operated, moving illuminated display for a helmet, disposed upon the rear thereof. The display is mounted on a module which adheres to the exterior of the helmet, as by hook and loop fastener. The illuminated display is provided by a series or matrix of light emitting diodes mounted to the module. Controlling electronic circuitry, a battery cell, and one of two actuating switches are also disposed upon the module. One actuating switch, located within the helmet and connected to the module by a cable, is a contact responsive switch which is tripped when the user dons the helmet. The other switch, mounted to the module, is a light sensor, which is exposed to ambient light and is responsive to fading daylight. At a predetermined ambient light level, and when the helmet is donned, power is supplied to the controller. The controller sequentially illuminates the LED display in stages, thus creating the visual impression of motion. The display continues until the ambient light level increases, or the helmet is doffed. The combination of motion and illumination enhances visibility of a cyclist wearing the novel helmet. Motorists who would otherwise be apt to overlook the cyclist are warned of his or her presence on a roadway. The system is readily attached to an otherwise conventional helmet, and may also be used with a backpack or the like.

20 Claims, 2 Drawing Sheets

ILLUMINATED HELMET

BACKGROUND OF THE INVENTION

1. Field of the Invention

The present invention relates to an illuminated helmet, preferably of the type worn by motorcyclists and bicyclists. The helmet automatically operates a moving illuminated display for warning motorists of the presence to the cyclist. The display, the controlling circuitry, and a power source are mounted to the helmet.

2. Description of the Prior Art

The problem of apparent near invisibility of cyclists to operators of larger vehicles, such as passenger sedans is well documented. This situation obviously leads to hazardous driving situations, especially given that a typical cyclist will tend to assume that he or she is fully visible to motorists driving adjacent vehicles. Yet the fact remains that motorists, while fully attuned to four wheeled vehicles, occasionally ignore the presence of cyclists.

This occurs under conditions of sufficient ambient light so that actual visibility appears not to be the direct cause of such incidents. Yet enhancing visibility or conspicuousness of the cyclist seems to offer one solution or area of improvement to the condition that now exists.

Solutions incorporating illumination of helmets have been proposed in the prior art.

U.K. Pat. Application No. 2,076,276, dated December, 1981, discloses a helmet mounted light for the twin purposes of novelty and safety. The lights flash in one embodiment, although no specific scheme presenting a specific visual effect is disclosed. The device is self-contained, having a battery cell housed within the helmet. However, switching is manual, and there is accordingly no automatic operation.

U.S. Pat. No. 4,901,210, issued to Akira Hanabusa on Feb. 13, 1990 teaches a removably attached safety light for a helmet having a rearwardly directed light. The device is self-contained, having a battery cell stored within. However, the device is purposefully detachable, which teaches away from incorporation of a safety light into a helmet. Also, the device is manually switched, unlike the automatic operation of the present invention.

A helmet adapted to display turn and brake signals originated conventionally upon a motorcycle is described in U.S. Pat. No. 4,891,736, issued to Adam Gouda on Jan. 2, 1990. The helmet is provided with external indicating lights located at the rear of the helmet. Wiring and connectors extend the electrical signalling circuitry of the motorcycle to the helmet for operating the indicating lights appropriately. The subject matter of this reference merely extends existing signalling functions of a motorcycle. There is no constantly operating, automatically initiated display of sequentially illuminated lights.

U.S. Pat. No. 5,155,669, issued to Yukio Yamuro on Oct. 13, 1992, discloses a low powered lighting assembly which could be employed as a component of the present invention. The lamps are light emitting diodes, which are selected for efficient use of electrical power, and satisfactory mechanical characteristics. This reference teaches mounting the subject device to a helmet. However, sequential flashing and automatic operation are not taught or suggested.

U.S. Pat. No. 5,313,187, issued to Robert S. Choi et al. on May 17, 1994, also discloses a lighting arrangement which could be employed in the present invention.

The inventors suggest the use of their novel lights on helmets for warning purposes. However, the technical discussion of switching and of controlling frequency and duration of flashing is directed to control of individual lamps. Sequential lighting thereof is not addressed. Specific construction details of a helmet and automatic initiation of operation are likewise not addressed.

None of the above inventions and patents, taken either singly or in combination, is seen to describe the instant invention as claimed.

SUMMARY OF THE INVENTION

The present invention provides a safety helmet for enhancing the visibility of a cyclist to motorists. Visibility is enhanced by providing an illumination system externally visible from the helmet. In addition to the characteristics of the illuminated display, two additional significant features of the present invention are that the illumination system operates automatically, and that the illumination system is entirely self-contained on the helmet. The illumination system adheres to the helmet exterior and interior surfaces. This characteristic avoids damaging penetration of the helmet, so that helmet integrity is maintained, and enables ready retrofitting to otherwise conventional helmets.

The illumination system is effective because it carries the prior art concept of flashing lights a step further. The ability of flashing lights to attract attention is well documented in the. cited prior art references. This ability is extended in the present invention by providing a series of individual lamps which are selectively illuminated in progressive steps of a predetermined sequence.

In each of the progressive steps, at least one, but not all of the lamps, is illuminated. In successive steps, the lamp illuminated in the prior step is extinguished, and an adjacent lamp is illuminated. Preferably, the illuminated lamp of each step is selected to be adjacent to illuminated lamps of a prior step. This pattern is continued so that lamps are illuminated in a right to left sequence.

This sequence of progressive steps creates the visual impression of motion. Therefore, not only does a motorist see a brightly lit, flashing light, but also a pattern of motion.

Another significant aspect of the invention is that, unlike the prior art systems, it operates automatically when a user or wearer dons the helmet. This arrangement overcomes the human propensity to ignore even quickly and easily performed operations to activate safety systems. A more frequently encountered example of ignoring safety systems is the well documented reluctance of many people to don seatbelts in automobiles, despite massive evidence of the effectiveness of these devices.

The invention incorporates an unobtrusive switch which initiates system operation automatically when a wearer's head contacts the switch. This is a desirable arrangement compared to other possible initiating switches. For example, the switch could be responsive to body heat, to vibration or motion, or to the voice of the user. However, each such example has an Achilles heel. In the first example, wearing clothing with high insulative qualities could defeat detection of body heat. A vibration or motion responsive device may not operate the system when the cycle is stationary, such as at traffic lights. And a user may simply forget to issue an appropriate voice command.

By contrast, a contact responsive switch located within the helmet, in particular located at the uppermost interior surface, provides not only automatic operation, but also provides reasonable assurance that the helmet is correctly and effectively worn.

It is also desirable that the illumination system be entirely self-contained on the helmet. This feature removes cumbersome, annoying or even unsafe connections to a motorcycle or other environmental object, such as, illustratively, a pocket mounted battery. It also avoids the chore of making necessary connections each time a rider mounts a motorcycle, if the system relies on the motorcycle for power or signals. The self-contained nature of the illumination system enables wider applications for the invention. For example, the novel illuminated system may be attached to a backpack or other item carried by a hiker or pedestrian.

The illumination system employs light emitting diodes as lamps. LEDs have well known advantages, such as brightness, low power demand, and compact and rugged construction, which are adequately discussed in the cited prior art, and will not be discussed in further detail herein.

Power is further conserved by a light sensing inhibition system. The illumination system is highly effective at dusk and after dark, so that a light sensor controls the system accordingly, inhibiting operation in full daylight.

The system is operated by an electronic control circuit, due to the ability of this type of equipment to provide many and varied control functions and signals in a compact and energy efficient package.

Accordingly, it is a principal object of the invention to provide an illuminated helmet for rendering a cyclist more conspicuous, especially to the motoring public.

It is another object of the invention to provide for automatic operation of the illuminated helmet.

It is a further object of the invention to initiate operation of the illumination system responsive to a user donning the helmet. Still another object of the invention is to provide an illuminated series or matrix of lamps which, when operating, create the visual impression of motion. An additional object of the invention is to conserve energy by inhibiting operation in full daylight. It is again an object of the invention to be self-contained and independent from external connections. A further object of the invention is to fasten the illumination system to a helmet removably by adhesion. Yet another object of the invention is to control the illumination system from a compact control device capable of generating a wide variety of command signals. It is an object of the invention to provide improved elements and arrangements thereof in an apparatus for the purposes described which is inexpensive, dependable and fully effective in accomplishing its intended purposes. These and other objects of the present invention will become readily apparent upon further review of the following specification and drawings.

DETAILED DESCRIPTION OF THE PREFERRED EMBODIMENT

Figure 1:
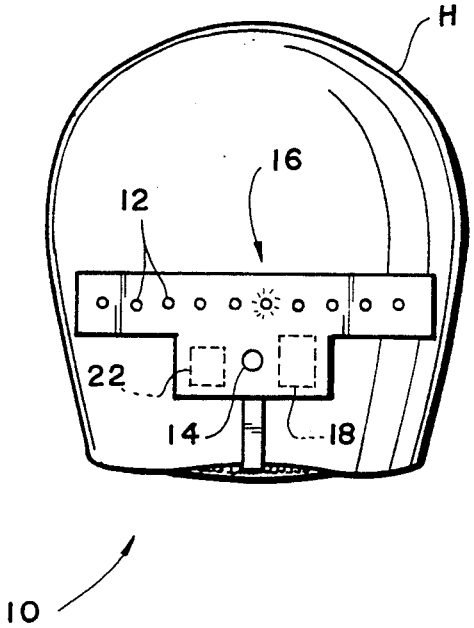
FIG. 1 is a rear elevational view of an illuminated helmet.

Turning now to FIG. 1 of the drawings, the novel illumination system 10 is seen mounted on a helmet H of generally conventional appearance. A series of lamps 12 is mounted upon helmet H so as to be externally visible. A preferred location of illumination system 10 is the rear of helmet H, but the invention may be practiced by locating lamps 12 at the sides, front, or any combination of locations.

Also visible in this view is a light detector 14. Detector 14 is exposed to ambient light and is responsive to a predetermined level thereof. Detector 14 functions as a switch inhibiting power to the illumination system responsive to detection of a predetermined level of ambient light.

It is preferred that lamps 12 be illuminated selectively, in progressive steps. Examination of this Figure will reveal that in one representative step, one lamp is illuminated, as indicated at 16. All other lamps are extinguished. In a preferred predetermined sequence of progressive steps, an adjacent lamp is subsequently illuminated, with all other lamps extinguished. This pattern of illumination is continued, wherein each succeeding illuminated lamp is located to the left of a preceeding illuminated lamp.

The pattern proceeds from right to left, and then proceeds back to the right side of helmet H. As the eyes of an observer track each succeeding illuminated column, an impression of motion from right to left is created. This sequence is illustrative, and any sequence that results in apparent motion would serve the purposes of the invention.

Major components of the illumination system are seen in this Figure. An electronic control circuit 18 is disposed within illumination system 10 and generates signals for selectively illuminating and extinguishing lamps 12 so as to achieve the predetermined sequence discussed above. Control circuit 18 is also operably connected to light detector 14, an automatic switch 20 (see FIG. 2), and a power source, the latter preferably comprising a battery cell 22.

Figure 2:
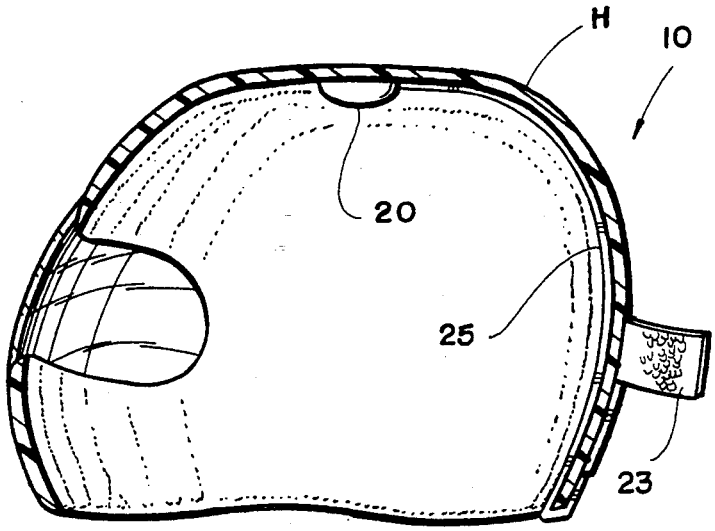
FIG. 2 is a side, cross sectional view of an illuminated helmet, showing the switch and a preferred attachment of the external unit to the outside surface of the helmet.

As will also be seen in FIG. 2, all components are located on exterior and interior surfaces of helmet H. The components are adhered to helmet H by any suitable fastener, such as hook and loop material 23. Of course, other fasteners may be employed, such as snaps, screws, glue, and still others. However, it is preferred that the fastener not penetrate the helmet in order to preserve the structural integrity thereof. Also, it is desirable to make illumination system 10 readily removable from the helmet, for transferring to another helmet, for servicing, and for security.

The components are conveniently and effectively located, and avoid penetration of helmet H. Thus, illumination system is quickly installed in any ordinary, preexisting helmet.

The illustrated location of switch 20 is advantageous since switch 20 is a contact responsive switch which operates when contact is made with the head of a user (not shown). This arrangement initiates operation of the illumination system responsive to donning and proper positioning of helmet H upon the user's head. Thus, the illumination is automatically operated.

Switch 20 is connected to illumination system by a flat cable 25 or other suitable flexible conductor.

Figure 3:
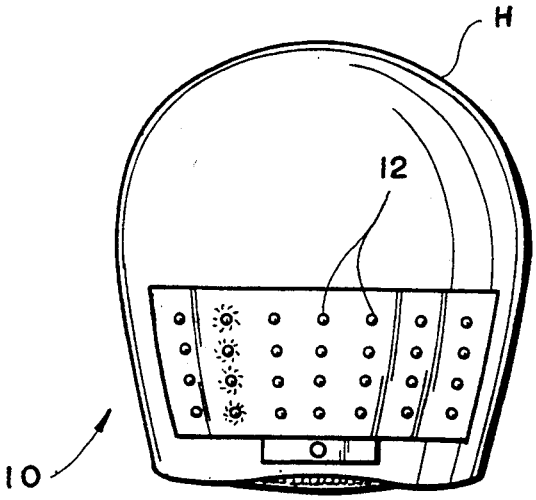
FIG. 3 is a rear elevational view of a second embodiment of the invention, wherein a matrix of lights is employed.

FIG. 3 illustrates an alternative embodiment, wherein a matrix of lamps 12 is provided in lieu of the linear arrangement of FIG. 1. In the second embodiment, a vertical column of lamps 12 is illuminated in lieu of the sole lamp of the first embodiment.

Figure 4:
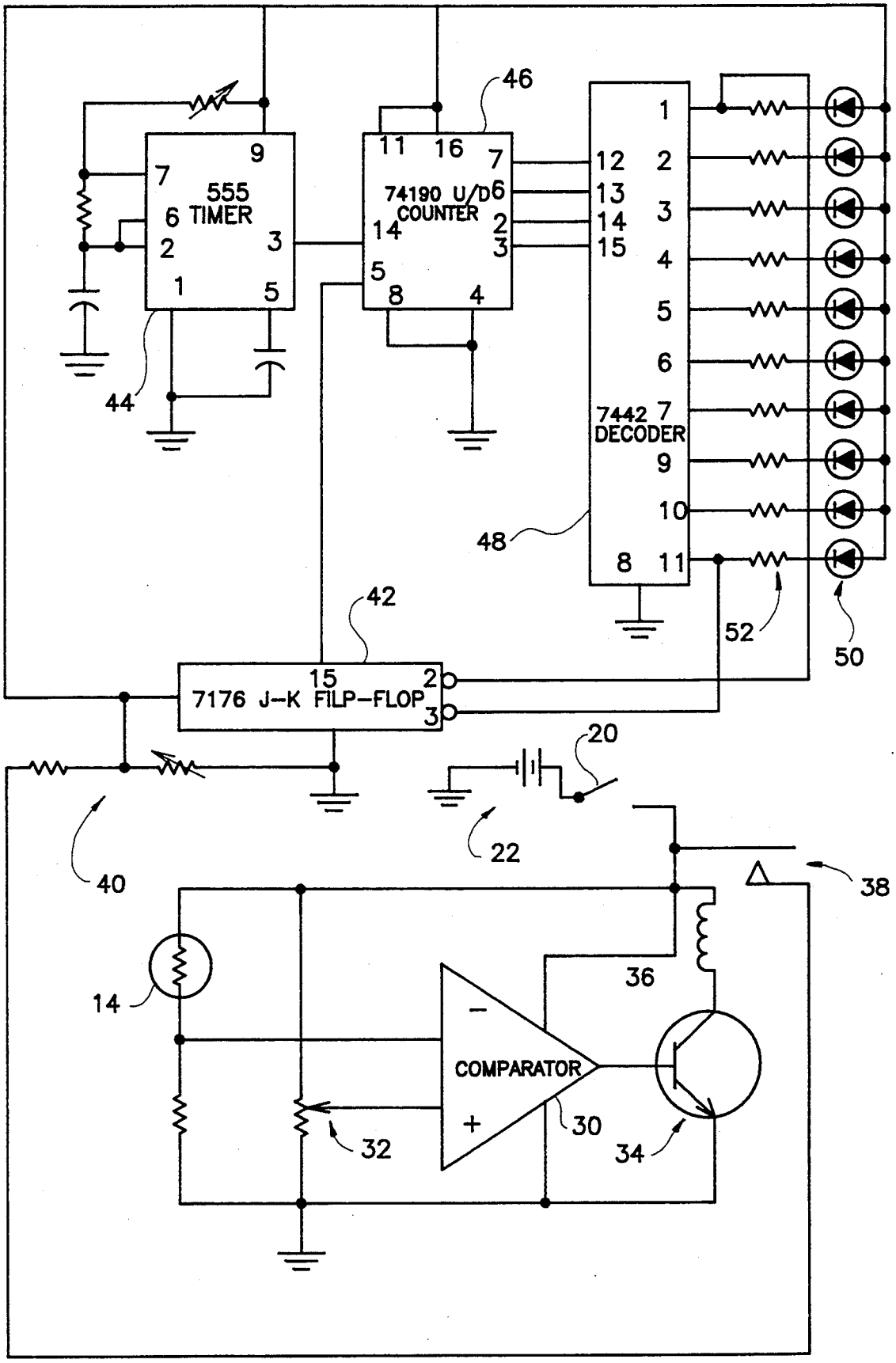
FIG. 4 is an electrical schematic showing the control circuit. Similar reference characters denote corresponding features consistently throughout the attached drawings.

Referring now to FIG. 4, wherein control circuit 18 is illustrated, voltage from battery cell 22 is not present until switch 20 is closed. When switch 20 closes, voltage is present at lines A and B. Detector 14 is a variable resistance device which decreases in resistance with increasing light level. As resistance increases, as would be the case when daylight is fading, voltage present at the negative input end of a comparator 30 decreases. A potentiometer 32 is employed to set a threshhold voltage at the positive input end of comparator 30.

Once the voltage present at the negative input end drops below the threshhold voltage of potentiometer 32, the comparator output becomes positive, thereby driving transistor 34. This in turn supplies current to a coil 36 of a relay (not shown in its entirety). Contacts 38 of the relay close, thus providing power to the rest of the control circuit.

A voltage divider 40 enables a portion of the supply voltage to be imposed upon subsequent components. These components include a J-K flip-flop 42, a 555 timer 44 used as an astable multivibrator, a 74190 up/-down counter 46, and a 7442 decoder 48. Of course, a resistor of fixed value may be provided in place of the potentiometer shown as part of voltage divider 40.

In operation, 555 timer 44 outputs to its pin 3 a series of pulses at a predetermined rate which are input to pin 14 of up/down counter 46. J-K flip-flop 42 has an output at pin 15 leading to pin 5 of up/down counter 46. The output of up/down counter 46 is a hexadecimal number represented in binary form at pins 7, 6, 2, and 3. This output is fed to decoder 48.

Decoder 48 sequentially grounds a plurality of LEDs 50 through respective resistors 52, which resistors 52 prevent excessive current flow which might burn out LEDs 50. Although the depiction of control circuit 18 shows only one LED 50 being illuminated at one time, it would occur to one of ordinary skill in the art to arrange the circuit to illuminate several LEDs simultaneously.

The sequence starts with the LED connected to pin 1 of decoder 48, and proceeds to the LED connected to pin 11. When the final LED in the sequence is illuminated, J-K flip-flop 42 reverses the direction of the sequence by counting down. Decoder 48 then sequentially connects LEDs 50 to ground, thereby illuminating the same, in reverse order. When the reversed order is complete, J-K flip-flop will again reverse the direction of the sequence. This pattern repeats as long as the illumination system is in operation.

It is to be understood that the present invention is not limited to the sole embodiment described above, but encompasses any and all embodiments within the scope of the following claims.

I claim:

1. An automatically operated illumination system for use with a helmet, comprising:

at least one externally visible lamp mounted upon the helmet, and means for illuminating said lamp; and an automatic switch mounted to the helmet, for initiating operation of said illumination system responsive to donning of the helmet, whereby initiation of operation of said illumination system is automatically performed when a user dons the helmet.

2. The illumination system according to claim 1, further comprising a plurality of externally visible lamps, and said means for illuminating said lamp further comprising means for selectively illuminating and extinguishing individual lamps in a predetermined sequence.

3. The illumination system according to claim 2, said lamps comprising light emitting diodes.

4. The illumination system according to claim 2, said means for selectively illuminating and extinguishing further including means for illuminating and extinguishing individual lamps in a predetermined sequence of progressive steps.

5. The illumination system according to claim 3, said means for selectively illuminating individual lamps comprising electronic circuitry for generating signals for selectively illuminating and extinguishing individual lamps.

6. The illumination system according to claim 1, further comprising a light sensor exposed to ambient light, said light sensor operably connected to said illumination system for inhibiting operation thereof responsive to detection of a predetermined level of ambient light.

7. The illumination system according to claim 1, further comprising an integral power source operably connected to said illumination system, whereby said illumination system is independent of connections and components external to the helmet.

8. The illumination system according to claim 7, said power source comprising a battery cell.

9. The illumination system according to claim 1, said automatic switch comprising a contact responsive switch mounted inside the helmet, whereby a wearer's head trips said pressure switch when the helmet is donned, and a cable communicating between said automatic switch and said at least one externally visible lamp.

10. The illumination system according to claim 1, further including means for adhering said illumination system to the helmet.

11. An automatically operated illumination system for attachment to a helmet, comprising:

a plurality of externally visible lamps mounted on the exterior of the helmet;

electronic circuitry connected to said lamps, for selectively illuminating and extinguishing individual lamps in a predetermined sequence of progressive steps;

an automatic switch mounted to the helmet and electrically connected to said illumination system, for initiating operation of said illumination system responsive to donning of the helmet, whereby initiation of operation is automatically performed when a user dons the helmet; and means for adhering said illumination system to the helmet.

12. The illumination system according to claim 11, further comprising a light sensor exposed to ambient light, said light sensor operably connected to said illumination system for inhibiting operation of said illumination system responsive to detection of a predetermined level of ambient light.

13. The illumination system according to claim 11, further comprising a power source integral therewith and operably connected to said illumination system, whereby said illumination system is independent of connections and components external to the helmet.

14. The illumination system according to claim 13, said power source comprising a battery cell.

15. The illumination system according to claim 11, said automatic switch comprising a contact responsive switch mounted inside the helmet and electrically connected to said illumination system, whereby a wearer's head trips said contact responsive switch when the helmet is donned.

16. The illumination system according to claim 11, said lamps comprising light emitting diodes.

17. A helmet including an automatically operated illumination system, comprising:

a helmet;

a plurality of externally visible lamps mounted exteriorly of said helmet;

electronic circuitry connected to said lamps for selectively illuminating and extinguishing individual lamps in a predetermined sequence of progressive steps;

an automatic switch mounted to said helmet for initiating operation of said illumination system responsive to donning of said helmet, whereby initiation of operation is automatically performed when a user dons said helmet;

a battery cell integral with said illumination system, operably connected to provide power to said illumination system; and means for adhering said illumination to said helmet.

18. The helmet according to claim 17, further comprising a light sensor exposed to ambient light, said light sensor operably connected to said illumination system for inhibiting operation thereof responsive to detection of a predetermined level of ambient light.

19. The helmet according to claim 17, said automatic switch comprising a contact responsive switch mounted inside said helmet, whereby a wearer's head trips said contact responsive switch when said helmet is donned.

20. The helmet according to claim 17, said lamps comprising light emitting diodes.

* * * * *